US009810049B2

(12) United States Patent
Dean et al.

(10) Patent No.: US 9,810,049 B2
(45) Date of Patent: Nov. 7, 2017

(54) SYSTEMS AND METHODS FOR INLINE CHEMICAL INJECTION FOR DUMP FLOOD WATER INJECTORS

(71) Applicant: Chevron U.S.A. Inc., San Ramon, CA (US)

(72) Inventors: Robert Matthew Dean, Houston, TX (US); Varadarajan Dwarakanath, Houston, TX (US); Taimur Malik, Houston, TX (US); Will Sherman Slaughter, Katy, TX (US); Dustin L. Walker, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 51 days.

(21) Appl. No.: 14/750,284

(22) Filed: Jun. 25, 2015

(65) Prior Publication Data

US 2015/0376998 A1 Dec. 31, 2015

Related U.S. Application Data

(60) Provisional application No. 62/016,957, filed on Jun. 25, 2014.

(51) Int. Cl.

| | |
|---|---|
| ***E21B 43/16*** | (2006.01) |
| ***E21B 33/124*** | (2006.01) |
| ***E21B 43/11*** | (2006.01) |
| ***E21B 43/12*** | (2006.01) |

(52) U.S. Cl.
CPC ..... *E21B 43/16* (2013.01); *E21B 33/124* (2013.01); *E21B 43/11* (2013.01); *E21B 43/128* (2013.01)

(58) Field of Classification Search
CPC ..... E21B 43/162; E21B 43/16
See application file for complete search history.

(56) References Cited

U.S. PATENT DOCUMENTS

| | | | |
|---|---|---|---|
| 4,064,941 | A | 12/1977 | Smith |
| 5,392,855 | A | 2/1995 | Bernardi, Jr. et al. |
| 5,582,251 | A | 12/1996 | Bailey et al. |
| 6,260,628 | B1 | 7/2001 | Magnus |
| 7,770,641 | B2 | 8/2010 | Dwarakanath et al. |
| 8,230,919 | B2 * | 7/2012 | Goodwin ..... E21B 33/1208 166/250.17 |
| 8,807,822 | B2 | 8/2014 | Fripp et al. |
| 2012/0216899 | A1 | 8/2012 | Broussard et al. |
| 2013/0128688 | A1 | 5/2013 | Doolin et al. |

FOREIGN PATENT DOCUMENTS

| | | |
|---|---|---|
| WO | 2015/020654 | 2/2015 |

* cited by examiner

*Primary Examiner* — Catherine Loikith

(57) ABSTRACT

The present disclosure provides techniques for inline injection of water and chemicals for a dump flood. The techniques include collecting water from a source reservoir into a water collection zone of an adjacent water injection well, and injecting a chemical solution into the water injection well. The water and the chemical solution are then mixed downhole in a mixer, such as a static mixer. The mixed injection fluid is then directly injected into an adjacent target reservoir.

23 Claims, 6 Drawing Sheets

SYSTEMS AND METHODS FOR INLINE CHEMICAL INJECTION FOR DUMP FLOOD WATER INJECTORS

CROSS REFERENCE TO RELATED APPLICATIONS

This application claims benefit under 35 USC 119 of U.S. Provisional Patent Application No. 62/016,957 with a filing date of Jun. 25, 2014. This application claims priority to and benefits from the foregoing, the disclosure of which is incorporated herein by reference.

TECHNICAL FIELD

The present application relates to dump flood water injection. Specifically, the present application relates to systems and methods of injecting and mixing water and chemicals for a dump flood operation.

BACKGROUND

Many old and aging oil reservoirs have remaining oil that could not be recovered through traditional recovery methods. In order to recover the remaining oil, enhanced oil recovery methods are deployed. One such method is a water flood, in which water is injected into the oil reservoir at one or more injection sites within a vicinity of the producing well. The water injected into the oil reservoir increases the pressure in the oil reservoir, which pushes the remaining oil towards the producing well where it can be recovered. In a dump flood, water is collected from a local source reservoir or other water source. The collected water is then injected downhole and into the oil reservoir. However, in certain environments, a dump flood could yield better results if the water injected had certain properties, such as those which may be obtained through certain chemical additives, such as in chemically enhanced oil recovery methods. However, general methods of creating an applicable chemical and water mixture utilizes large surface equipment in order to process the water and mix in the chemical solution, which requires a large amount of land area. Thus, such techniques are not accessible for certain dump flood applications and environments where surface space is limited, for example.

SUMMARY

In general, in one aspect, the disclosure relates to a method of inline water injection. The method includes collecting water from a source reservoir into a water collection zone of a water injection well, wherein the water injection well is adjacent to the source reservoir, and injecting the water through a static mixer, wherein the static mixer is disposed in the water injection well. The method also includes delivering and injecting a concentrated chemical solution from a source outside of the water injection well into the static mixer while injecting the water through the static mixer, and mixing the water and the concentrated chemical solution in the static mixer, resulting in an injection fluid. The method further includes injecting the injection fluid into a target reservoir.

In another aspect, the disclosure can generally relate to an inline water injection system. The inline water injection system includes a first packer disposed within a water injection well at a first level, and a second packer disposed within the water injection well at a second level below the first packer, wherein the water injection well comprises a water collection zone between the first packer and the second packer. The inline water injection system further includes a static mixer disposed within the water injection well, and one or more injection tubings disposed within the water injection well traversing the first and second packers, wherein the one or more injection tubings deliver water from an adjacent source reservoir and a chemical solution from an above-ground source into the static mixer, wherein the static mixer mixes the water and the chemical solution into an injection fluid, and wherein the injection fluid is injected into a target reservoir adjacent the water injection well.

In another aspect, the disclosure can generally relate to a method of inline water injection. The method includes pumping a concentrated chemical solution into an injection tubing, wherein the injection tubing is disposed within a water injection well, and collecting water from a source reservoir into the injection tubing, wherein the water injection well is adjacent to the source reservoir. The method also includes injecting the concentrated chemical solution and the water through a mixer, wherein the concentrated chemical solution and the water are mixed into an injection fluid. The method further includes injecting the injection fluid into a target reservoir adjacent the water injection well.

These and other aspects, objects, features, and embodiments will be apparent from the following description and the appended claims.

BRIEF DESCRIPTION OF THE DRAWINGS

The drawings illustrate only example embodiments of the present disclosure, and are therefore not to be considered limiting of its scope, as the disclosures herein may admit to other equally effective embodiments. The elements and features shown in the drawings are not necessarily to scale, emphasis instead being placed upon clearly illustrating the principles of the example embodiments. Additionally, certain dimensions or positioning may be exaggerated to help visually convey such principles. In the drawings, reference numerals designate like or corresponding, but not necessarily identical, elements. In one or more embodiments, one or more of the features shown in each of the figures may be omitted, added, repeated, and/or substituted. Accordingly, embodiments of the present disclosure should not be limited to the specific arrangements of components shown in these figures.

DETAILED DESCRIPTION OF EXAMPLE EMBODIMENTS

Figure 1:
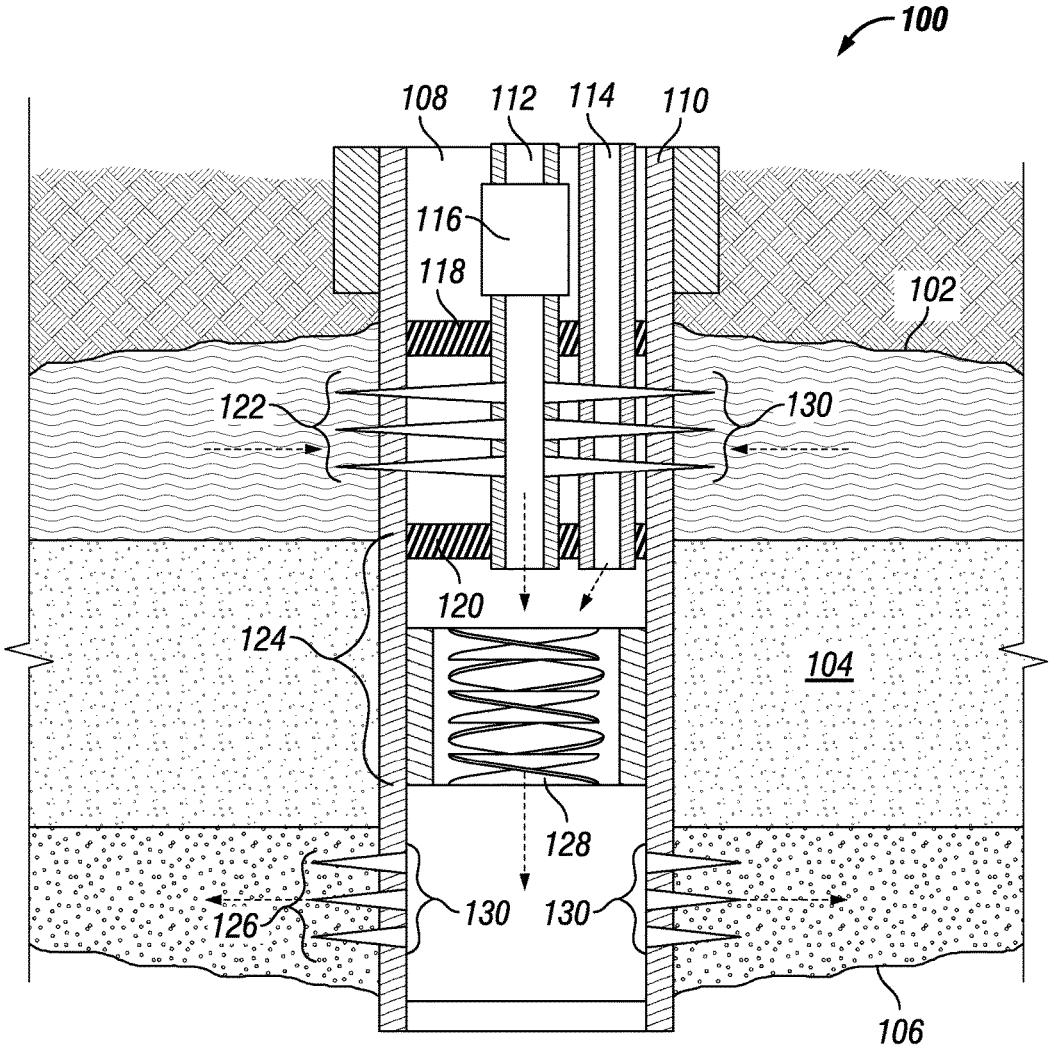
FIG. 1 illustrates a first example embodiment of an inline chemical injection system.

Embodiments of the present disclosure include methods of mixing and injecting a chemical fluid into an injection well in-line during a dump flood. In certain example embodiments, the injection fluid is created by mixing, downhole, one or more chemical solutions with water collected from a source reservoir. In certain example embodiments, the injection fluid includes a water soluble polymer and/or surfactant.

As used herein, the term "equal" refers to equal values or values within the standard of error of measuring such values. The term "substantially equal" refers to an amount that is within 3% of the value recited. The term "about" refers to an amount that is within 10% of the value recited.

As used herein, "a" or "an" means "at least one" or "one or more" unless otherwise indicated. As used herein "multi-" or "plurality" refers to 2 or more.

"Effective amount," refers to an amount sufficient to effect an increase in oil recovery over not including the component. For example, an effective amount of surfactant in a surfactant-polymer (SP) slug would increase oil recovery over only using the equivalent polymer slug without surfactant. As another example, an effective amount of polymer in a polymer slug would increase oil recovery over only using the equivalent slug without polymer.

"Pore volume" or "PV" fraction as used herein refers to the total volume of pore space in the oil reservoir that is contemplated in a sweep (Alkali-Surfactant-Polymer (ASP), Surfactant-Polymer (SP), Alkali-Polymer (AP), and/or Polymer Drive (PD) mobility ratio).

"Slug," as used herein, refers to an amount in PV of a composition that is to be injected into a subterranean reservoir.

As used herein, "surfactant" refers to a compound which comprises at least one hydrophilic group and at least one hydrophobic group.

As used herein, a "desired chemical concentration" refers to the amount of chemical, such as polymer or surfactant, which is desired to be injected into a specific reservoir. As used herein, a "concentrated chemical solution" refers to a concentration of a chemical in a solution which is higher than the desired chemical concentration.

As used herein, a "source reservoir" refers to a reservoir bearing water. A source reservoir can also be referred to as a "wet reservoir."

As used herein, a "target reservoir" refers to a reservoir bearing hydrocarbons. A target reservoir can also be referred to as an "oil reservoir."

In certain example embodiments, a concentrated chemical solution, such as a concentrated polymer solution, is mixed with source reservoir water in-line during the operation of a dump flood. In specific embodiments, the mixing is done with a static mixer. In certain example embodiments, the concentrated chemical solution is pumped into a mixing zone of the line at a controlled rate. In certain example embodiments, the concentrated chemical solution is pumped into the line at a set ratio with respect to the rate the source reservoir water is taken in, such that the combination of source reservoir water and chemical solution results in an injection fluid of a desired chemical concentration. For example, if a chemical concentration of 0.2% is desired, and the concentrated chemical solution pumped into the line has a 1% chemical concentration, then the rate of injection of the concentrated chemical solution would be controlled at 20% of the rate of the total fluid injection, or at 25% of the rate of the source reservoir water intake. In embodiments of the disclosure, the rate of source reservoir water intake is measured and the rate of concentrated chemical solution pumped into the line is modified to maintain about the desired chemical concentration for injection into the reservoir.

In certain example embodiments, the concentrated polymer solution inflow rate is determined based on the natural source reservoir inflow rate and the desired polymer concentration of the final injection fluid. For example, the concentrated polymer solution inflow rate is determined by obtaining the desired polymer concentration value of the final injection fluid and the concentration value of the concentrated polymer solution. Also known as the source reservoir inflow rate. The proper concentrated polymer solution inflow rate is determined by dividing the desired polymer concentration of the final mixture by the polymer concentration of the concentrated polymer solution, and multiplying the result by the source reservoir inflow rate. The concentrated polymer solution is pumped into the injection well at the determined concentrated polymer solution inflow rate. In certain example embodiments, the concentrated polymer solution and the water collected from the source reservoir are mixed together by the static mixer to create the injection fluid. In certain example embodiments using shear insensitive polymers, a pump can serve the purpose of the mixer.

In certain example embodiments, the inflow of water into the injection well 108 from the source reservoir 102 is controlled by a pump, in which the water inflow rate, which replaces the source reservoir inflow rate discussed above, is controlled. Thus, both the inflow rate of the water and the concentrated polymer solution are controlled to provide the desire polymer concentration and injection rate into the target reservoir.

In certain example embodiments, the injection fluid includes a mixture of polymer, surfactant, and water. In certain example embodiments, surfactant is provided at some concentration in the field between any of 10% to 100% active, such as between 10-20%, 20-30%, 30-40%, 40-50%, 50-60%, 60-70%, 70-80%, 80-90%, 90-100%, 10-30%, 20-40%, 30-50%, 40-60%, 50-70%, 60-80%, 70-90%, 80-100%, 10-40%, 20-50%, 30-60%, 40-70%, 50-80%, 60-90%, 70-100%, 10-50%, and 50-100% active. In certain example embodiments, if co-solvent is used, it can be blended with the surfactant at the proper ratio and thus, in some embodiments, no extra calculation is needed to be done to ensure the proper concentration of co-solvent is achieved. In certain example embodiments, surfactant is a separate injection stream from the concentrated polymer solution. In some cases, surfactant is added to the water in the concentrated polymer solution at the same concentration factor as the polymer, i.e. if polymer needs to go from 1% to 0.2%, then the surfactant needs to be concentrated at 5 times of the desired surfactant concentration of the final injection fluid. In certain example embodiments, when the surfactant is an additional stream, it is blended with the concentrated polymer solution at the surface and then injected downhole through one of the above techniques.

In certain example embodiments, in order to achieve the desired composition of the injection fluid, a concentrated polymer solution and a surfactant solution are mixed together at a proper ratio. The mixture is then delivered into the injection well at a proper inflow rate compared to source reservoir inflow rate such that the concentration of polymer and the concentration of surfactant of the final injection fluid desired. For example, the proper inflow rate of concentrated polymer solution and the proper inflow rate of surfactant can be determined mathematically when the concentration of the concentrated polymer solution, the active concentration of the surfactant solution, the desired polymer concentration of the final injection fluid, the inflow rate of water from the source reservoir and the desired surfactant concentration of the final injection fluid are known. In certain example embodiments, the concentrated polymer solution and the surfactant solution are premixed according to the determined ratio at the surface and then delivered downhole, wherein it is mixed with water from the source reservoir at the prescribed ratio. In certain other example embodiments, the concentrated polymer solution and the surfactant solution are delivered downhole individually at their respective rates. In such an example embodiment, the concentrated polymer solution, the surfactant solution, and source reservoir water are all mixed together downhole.

Water soluble polymers, such as those commonly employed for enhanced oil recovery, are included to control the mobility of the injection solution. Such polymers include, but are not limited to, biopolymers such as xanthan gum, schizophyllan, and scleroglucan and synthetic polymers such as partially hydrolyzed polyacrylamides (HPAMs or PHPAs) and hydrophobically-modified associative polymers (APs). Also included are co-polymers of polyacrylamide (PAM) and one or both of 2-acrylamido 2-methylpropane sulfonic acid (and/or sodium salt) commonly referred to as AMPS (also more generally known as acrylamido tertiobutyl sulfonic acid or ATBS) and N-vinyl pyrrolidone (NVP). Molecular weights (Mw) of the polymers range from about 100,000 Daltons to about 30,000,000 Daltons, such as about 100,000 to about 500,000, or about 1,000,000 to about 20,000,000 Daltons. In specific embodiments of the invention the polymer is about 2,000,000 Daltons, about 8,000,000 Daltons, or about 20,000,000 Daltons. The polymer and the size of the polymer may be tailored to the permeability, temperature and salinity of the reservoir. In certain example embodiments, mixtures of synthetic polymers are used for certain applications including high salinity and high temperature polymer flooding. Typically, synthetic polymers are considered shear sensitive and biopolymers are shear insensitive.

Effective amounts of polymer are concentrations that allow the slug to efficiently sweep the reservoir. The required viscosity is a function of mobility ratio. Mobility ratio (M) is defined as water (or ASP) relative permeability divided by oil relative permeability multiplied by oil viscosity divided by water (or ASP) viscosity (krw/kro*μo/μw). Generally a unit mobility ratio, M=1, or lower is desired in an ASP flood. In one example, effective amounts of polymer are equal to or less than that of each subsequent slug's viscosity in order obtain favorable mobility ratio throughout the entire flood process. For example, effective amounts of polymer include, but are not limited to about 250 ppm to about 5,000 ppm, such as about 500 to about 2500 ppm concentration, or about 750 to 3000 ppm in order to achieve a favorable mobility ratio under the reservoir conditions of temperature. Different slugs may comprise different amounts of polymer.

In certain example embodiments, for a shear sensitive polymer injection fluid, polymer can be hydrated at the surface at a concentration between 0.5% and 1.5% generally close to 1%, called a concentrated polymer solution. The polymer can be supplied either in powder or in emulsion form. A surface pump then delivers the polymer through a wellhead manifold and into a chemical injection tubing. The desired polymer concentration of the final injection fluid to be injected into the target reservoir is generally between any of 0.05% to 0.5%, such as 0.05-0.15%, 0.15-0.25%, 0.25-0.35%, 0.35-0.50%, 0.05-0.3%, and 0.3%-0.5%. In certain example embodiments, the concentrated polymer solution will have to be delivered at any of 3.33% to 50% of the source reservoir inflow rate in order to dilute to the desired concentration of the final injection fluid, such as any of 3.33-10%, 10-20%, 20-30%, 30-40%, 40-50%, 3.33-15%, 15-30%, 30%-50%, 3.33-25%, and 25%-50%.

Surfactants are included to lower the interfacial tension between the oil and water phase to less than about 10^-2 dyne/cm (for example) and thereby recover additional oil by mobilizing and solubilizing oil trapped by capillary forces. Examples of surfactants that can be utilized include, but are not limited to, anionic surfactants, cationic surfactants, amphoteric surfactants, non-ionic surfactants, or a combination thereof. Anionic surfactants can include sulfates, sulfonates, phosphates, or carboxylates. Such anionic surfactants are known and described in the art in, for example, U.S. Pat. No. 7,770,641, incorporated herein in full. Examples of specific anionic surfactants include internal olefin sulfonates, isomerized olefin sulfonates, alkyl aryl sulfonates, medium alcohol (C10 to C17) alkoxy sulfates, alcohol ether [alkoxy] carboxylates, and alcohol ether [alkoxy] sulfates. Example cationic surfactants include primary, secondary, or tertiary amines, or quaternary ammonium cations. Example amphoteric surfactants include cationic surfactants that are linked to a terminal sulfonate or carboxylate group. Example non-ionic surfactants include alcohol alkoxylates such as alkylaryl alkoxy alcohols or alkyl alkoxy alcohols. Other non-ionic surfactants can include alkyl alkoxylated esters and alkyl polyglycosides. In some embodiments, multiple non-ionic surfactants such as non-ionic alcohols or non-ionic esters are combined. As a skilled artisan may appreciate, the surfactant(s) selection may vary depending upon such factors as salinity, temperature, and clay content in the reservoir.

In certain example embodiments, alkali or salt, commonly but not limited to $Na_2CO_3$ or NaCl, is provided as a powder and then diluted in a maturation tank at a concentration between 4% and the solubility limit of the salt in water (approximately 25%). This alkali or salt concentrated solution is then injected much like the concentrated surfactant and/or co-solvent/co-surfactant and concentrated polymer solution, as described above. In certain example embodiments, the desired alkali or salt concentrations to be injected into the target reservoir normally range between any of 0.5% and 5%, such as between 0.75% to 2%, 0.5% to 0.75%, 0.75% to 1%, 1% to 1.25%, 1.25% to 1.5%, 1.5% to 1.75%, 1.75% to 2%, 0.5% to 1%, 1% to 1.5%, 1.5% to 2%, 2% to 3%, and 3% to 5%. In embodiments, the mixing method downhole is dictated by the type of polymer being used (i.e., shear sensitive vs. shear insensitive). In embodiments, alkali employed is a basic salt of an alkali metal from Group IA metals of the Periodic Table. In an embodiment, the alkali metal salt is a base, such as an alkali metal hydroxide, carbonate or bicarbonate, including, but not limited to, sodium carbonate, sodium bicarbonate, sodium hydroxide, potassium hydroxide, sodium silicate, tetrasodium EDTA, sodium metaborate, sodium citrate, and sodium tetraborate. The desired alkali concentration may be used in amounts ranging from about 0.3 to about 5.0 weight percent of the solution, such as about 0.5 to about 3 weight percent.

In the example embodiments illustrated in FIGS. 1-6, various components, such as the pumps (ESP, PCP, etc.) and the static mixer can be replaced by alternate components which perform similar functions. For example the ESPs may be replaced with PCPs or eliminated, and the PCPs may be replaced by ESPs or eliminated. Likewise, the static mixer may be replaced by another non-shearing mixer such as a PCP. In certain example embodiments, such as embodiments involving shear insensitive chemicals, other types of mixers can be used, such as ESPs and PCPs. In embodiments of the disclosure a static mixer is used to mix shear sensitive or shear insensitive polymers downhole while a pump (e.g., functioning as an active mixer) may be used before to the static mixer to mix shear insensitive polymers downhole.

Example embodiments directed to systems and methods for inline chemical injection for dump flood water injectors will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments disclosed herein may be practiced without these specific details. In other instances, well-known features have not been described in detail to avoid unnecessarily complicating the description.

Referring now to the drawings, FIG. 1 illustrates a first embodiment of an inline polymer dump flood injection system 100, in accordance with example embodiments of the present disclosure. In certain example embodiments, the injection system 100 is used in a formation having a source reservoir layer 102, dividing or impermeable layers 104, and a target reservoir layer 106. The dividing or impermeable layers 104 can include shale, a combination of shales and smaller source reservoirs, gas reserves, or other oil reserves. In certain example embodiments, an injection well 108 is formed in an injection zone and completed with a casing 110. The injection well 108 is further completed by installing the injection system 100 therewithin. In certain example embodiments, the injection system 100 includes a water injection tubing 112, a chemical injection tubing 114, and a static mixer 128. Furthermore, in certain example embodiments, the injection well 108 is separated into a water collection zone 122, a mixing zone 124, and an injection zone 126. In certain example embodiments, the water collection zone 122 is substantially aligned with the source reservoir layer 102 of the formation, the injection zone 126 is substantially aligned with the target reservoir layer 106 of the formation, and the mixing zone 124 is disposed in between the water collection zone 122 and the injection zone 126.

In certain example embodiments, such as the example embodiment illustrated in FIG. 1, the water collection zone 122 is isolated between a first packer 118 disposed on top of the water collection zone 122 and a second packer 120 disposed between the water collection zone 122 and the mixing zone 124. In certain example embodiments, the water injection tubing 112 extends from the surface, where it is connected to a tubing string, and into the mixing zone 124, traversing the first packer 118 and the second packer 120. Accordingly, the tubing string is in fluid communication with the mixing zone 124. In certain example embodiments, the first packer 118 and second packer 120 are sealed around the water injection tubing 112. In certain example embodiments, the water injection tubing 112 and the casing 110 of the injection well 108 include a plurality of perforations 130, which put the water injection tubing 112 in fluid communication with the source reservoir layer 102. Water from the source reservoir layer 102 flows into the water collection zone through the perforations 130 in the casing 110 and then into the water injection tubing 112 through the perforations 130 in the water injection tubing 112. The water is then delivered into the mixing zone 124 via the water injection tubing 112. In certain example embodiments, the water injection tubing 112 is coupled to a pump 116, which facilitates the pulling of water out of the source reservoir layer 102 and the injection of water into the mixing zone 124. In certain example embodiments, the pump 116 controls the rate of water flow into the mixing zone 124.

In certain example embodiments, the chemical injection tubing 114 extends from the surface through to and terminating in the mixing zone 124. The chemical injection tubing 114 is coupled to a tubing string through which one or more chemicals is delivered downhole and into the mixing zone 124. In certain example embodiments, the chemical injection tubing 114 traverses the first packer 118 and the second packer 120 such that the first packer 118 and the second packer 120 form a seal around the chemical injection tubing 114. In certain example embodiments, the chemical injection tubing 114 traverses the water collection zone 122 while the inside of the chemical injection tubing 114 is isolated from the water collection zone 122. In certain example embodiments, during operation, a concentrated chemical solution, such as a concentrated polymer solution is pumped into the mixing zone 124 from the surface via the chemical injection tubing 114. In certain example embodiments, the concentrated chemical solution is pumped into the mixing zone 124 at a controlled rate. In certain example embodiments, the concentrated chemical solution is pumped into the mixing zone 124 at a set ratio with respect to the water pumped into the mixing zone 124 via the water injection tubing 112, such that the combination of water and chemical solution in the mixing zone 124 results in an injection fluid of a desired chemical concentration. For example, if a chemical concentration of 0.2% is desired, and the concentrated chemical solution pumped through the chemical injection tubing 114 has a 1% chemical concentration, then the rate of injection of the concentrated chemical solution would be controlled at 20% of the rate of the total fluid injection, or at 25% of the rate of the water injection.

In certain example embodiments, when the water and the concentrated chemical solution are injected into the mixing zone 124, the water and the concentrated chemical solution are forced to travel through the static mixer 128. In certain example embodiments, the static mixer 128 provides a path having a plurality of obstacles which force fluid traveling therethrough to take a winding path. Thus, when water and concentrated chemical solution are forced through the static mixer 128 together, the water and concentrated chemical solution are mixed together, and exit the static mixer 128 as a mixed injection fluid (e.g., as an evenly mixed injection fluid).

In certain example embodiments, the mixed injection fluid is then injected into the injection zone 126 and ultimately injected into the surrounding target reservoir 106 via perforations 130 in the casing 110. The injection fluid injected into the target reservoir 106 increases the pressure in the target reservoir 106. This mobilizes hydrocarbons in the target reservoir and pushes the hydrocarbons towards a neighboring producing well, where the hydrocarbons are can be recovered. The example embodiment of the injection system 100 illustrated in FIG. 1 can accommodate the use of shear-sensitive chemical solutions, such as synthetic polymers, including but not limited to Hydroloyzed polyacrylamide (HPAM), acrylamido-methyl-propane sulfonate (AMPS), HPAM/AMPS mixtures, N-Vinyl-pyrrolidone (NVP), and HPAM/AMPS/NVP mixtures. The concentrated chemical solution travels directly from a source to the mixing zone 124 via the chemical injection tubing 114. Thus, the concentrated chemical solution is not pulled through the pump 116, which may degrade shear-sensitive chemical solutions. Furthermore, the static mixer 128 allows the concentrated chemical solution to mix with the water without degrading shear-sensitive chemical solutions.

Figure 2:
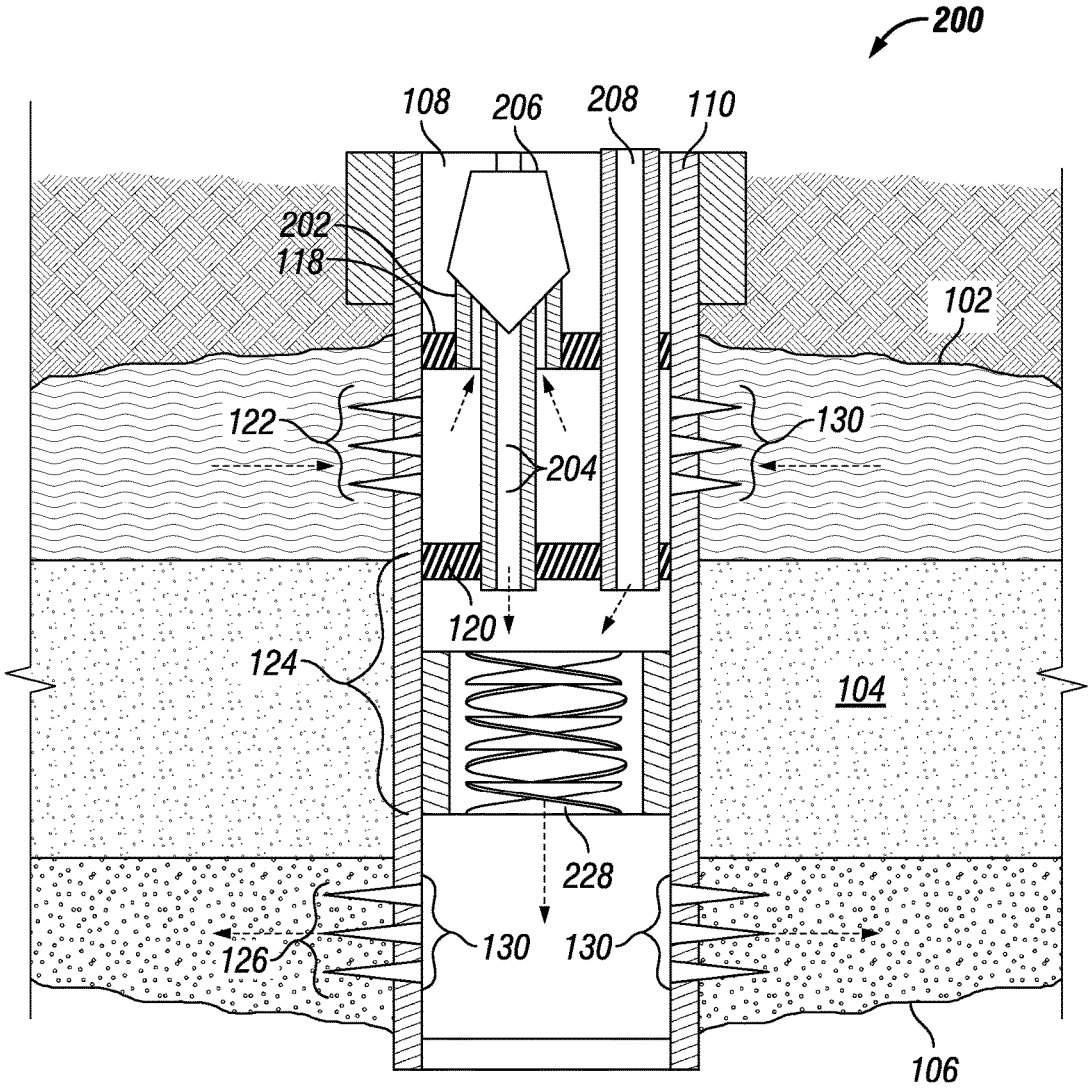
FIG. 2 illustrates a second example embodiment of an inline chemical injection system.

FIG. 2 illustrates a second example embodiment of an inline polymer dump flood injection system 200. Elements that are the same or comparable to the elements illustrated in the example shown in FIG. 1 are identified by the same reference number in FIGS. 2-6. Similar to the example illustrated in FIG. 1, the injection system 200 is installed within a cased injection well 108 having a source reservoir layer 102 and a target reservoir layer 106. In certain example embodiments, the injection well 108 is separated into the water collection zone 122, the mixing zone 124, and the injection zone 126. In certain example embodiments, the injection system 200 includes a water collection tubing 202, a water injection tubing 204, an electrical submersible pump (ESP) 206, a chemical injection tubing 208, and a static mixer 228. In certain example embodiments, the water collection zone 122 is isolated between a first packer 118 disposed on top of the water collection zone 122 and a second packer 120 disposed between the water collection zone 122 and the mixing zone 124. In certain example embodiments, the water collection tubing 202 extends from the water collection zone 122 to the ESP 206, which is located above the water collection zone 122. The water injection tubing 204 is disposed within the water collection tubing 202 and extends from the ESP 206 to the mixing zone 124, traversing the first packer 118 and the second packer 120. In certain example embodiments, water flows into the water collection zone 122 from the source reservoir 102 via a plurality of perforations 130 formed in the casing 110 of the injection well 108. The water is drawn into the ESP 206 through the water collection tubing 202, and then injected into the mixing zone 124 through the water injection tubing 204. The ESP 206 can be used to control the rate of water injected into the mixing zone 124.

In certain example embodiments, the chemical injection tubing 208 extends from the surface through to and terminating in the mixing zone 124. The chemical injection tubing 208 is coupled to a tubing string through which a concentrated chemical solution is delivered downhole and into the mixing zone 124. In certain example embodiments, the chemical injection tubing 208 traverses the first packer 118 and the second packer 120 such that the first packer 118 and the second packer 120 form a seal around the chemical injection tubing 208. In certain example embodiments, the chemical injection tubing 208 traverses the water collection zone 122 while the inside of the chemical injection tubing 208 is isolated from the water collection zone 122. Thus, the concentrated chemical solution is isolated from the ESP 206. In certain example embodiments, the concentrated chemical solution is pumped into the mixing zone 124 at a controlled rate. In certain example embodiments, the concentrated chemical solution is pumped into the mixing zone 124 at a set ratio with respect to the water pumped into the mixing zone 124 via the water injection tubing 204 and ESP 206, such that the combination of water and chemical solution in the mixing zone 124 results in an injection fluid of a desired chemical concentration.

In certain example embodiments, when the water and the concentrated chemical solution are injected into the mixing zone 124, the water and the concentrated chemical solution are forced to travel through the static mixer 228. When water and concentrated chemical solution are forced through the static mixer 228 together, the water and concentrated chemical solution are mixed together, and exit the static mixer 228 as a mixed injection fluid (e.g., as an evenly mixed injection fluid). In certain example embodiments, the mixed injection fluid is then injected into the injection zone 126 and ultimately injected into the surrounding target reservoir 106 via perforations formed in the casing 110. The example embodiment of the injection system 200 illustrated in FIG. 2 can accommodate the use of shear-sensitive chemical solutions, such as synthetic polymers as described above. The concentrated chemical solution travels directly from a source to the mixing zone 124 via the chemical injection tubing 114. Thus, the concentrated chemical solution is not pulled through the ESP 206, which may degrade shear-sensitive chemical solutions. Furthermore, the static mixer 228 allows the concentrated chemical solution to mix with the water without degrading shear-sensitive chemicals.

Figure 3:
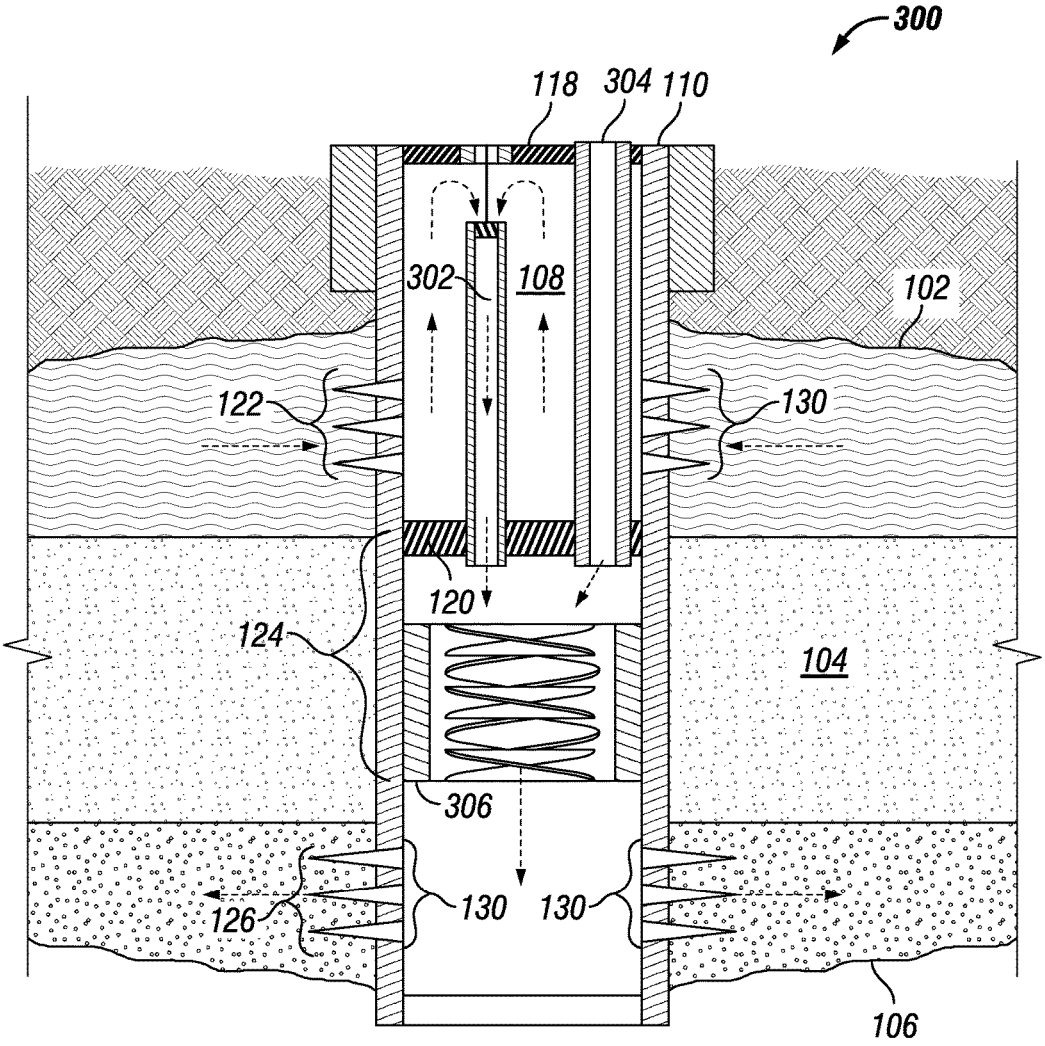
FIG. 3 illustrates a third example embodiment of an inline chemical injection system.

FIG. 3 illustrates a third example embodiment of an inline polymer dump flood injection system 300. In certain example embodiments, the injection system 300 includes a progressive cavity pump (PCP) 302, a chemical injection tubing 304, and a static mixer 306. In certain example embodiments, the water collection zone 122 is isolated between a first packer 118 disposed on top of the water collection zone 122 and a second packer 120 disposed between the water collection zone 122 and the mixing zone 124. In certain example embodiments, water flows into the water collection zone 122 from the source reservoir 102 via perforations 130 formed in the casing 110 of the injection well 108. The PCP 302 extends from the water collection zone 122 to the mixing zone 124, traversing the second packer 120. In certain example embodiments, the PCP 302 drives water from the water collection zone 122 into the mixing zone 124. The water collection zone 122 and the mixing zone 124 are otherwise isolated from each other. In one embodiment, the PCP 302 can include a stator and a drive rod, as well as an inlet towards the top of the PCP 302 and an outlet towards the bottom of the PCP 302. The water from the water collection zone 122 enters the PCP 302 through the inlet of the PCP 302 and the water exits through the outlet of the PCP 302. Thus, the PCP 302 can be used to control the rate of water injected into the mixing zone 124.

In certain example embodiments, the chemical injection tubing 304 extends from the surface through to and terminating in the mixing zone 124. The chemical injection tubing 304 is coupled to a tubing string through which a concentrated chemical solution is delivered downhole and into the mixing zone 124. In certain example embodiments, the chemical injection tubing 304 traverses the first packer 118 and the second packer 120 such that the first packer 118 and the second packer 120 form a seal around the chemical injection tubing 304. In certain example embodiments, the chemical injection tubing 304 traverses the water collection zone 122 while the inside of the chemical injection tubing 304 is isolated from the water collection zone 122. Thus, the concentrated chemical solution is isolated from the PCP 302. In certain example embodiments, the concentrated chemical solution is pumped into the mixing zone 124 at a controlled rate. In certain example embodiments, the concentrated chemical solution is pumped into the mixing zone 124 at a set ratio with respect to the water pumped into the mixing zone 124 via the PCP 302, such that the combination of water and chemical solution in the mixing zone 124 results in an injection fluid of a desired chemical concentration.

In certain example embodiments, when the water and the concentrated chemical solution are injected into the mixing zone 124, the water and the concentrated chemical solution are forced to travel through the static mixer 306. When water and concentrated chemical solution are forced through the static mixer 306 together, the water and concentrated chemical solution are mixed together, and exit the static mixer 306 as a mixed injection fluid (e.g., as an evenly mixed injection fluid). In certain example embodiments, the mixed injection fluid is then injected into the injection zone 126 and ultimately injected into the surrounding target reservoir 106 via perforations formed in the casing 110. The example embodiment of the injection system 300 illustrated in FIG. 3 can accommodate the use of shear-sensitive chemical solutions, such as synthetic polymers as described above.

Figure 4:
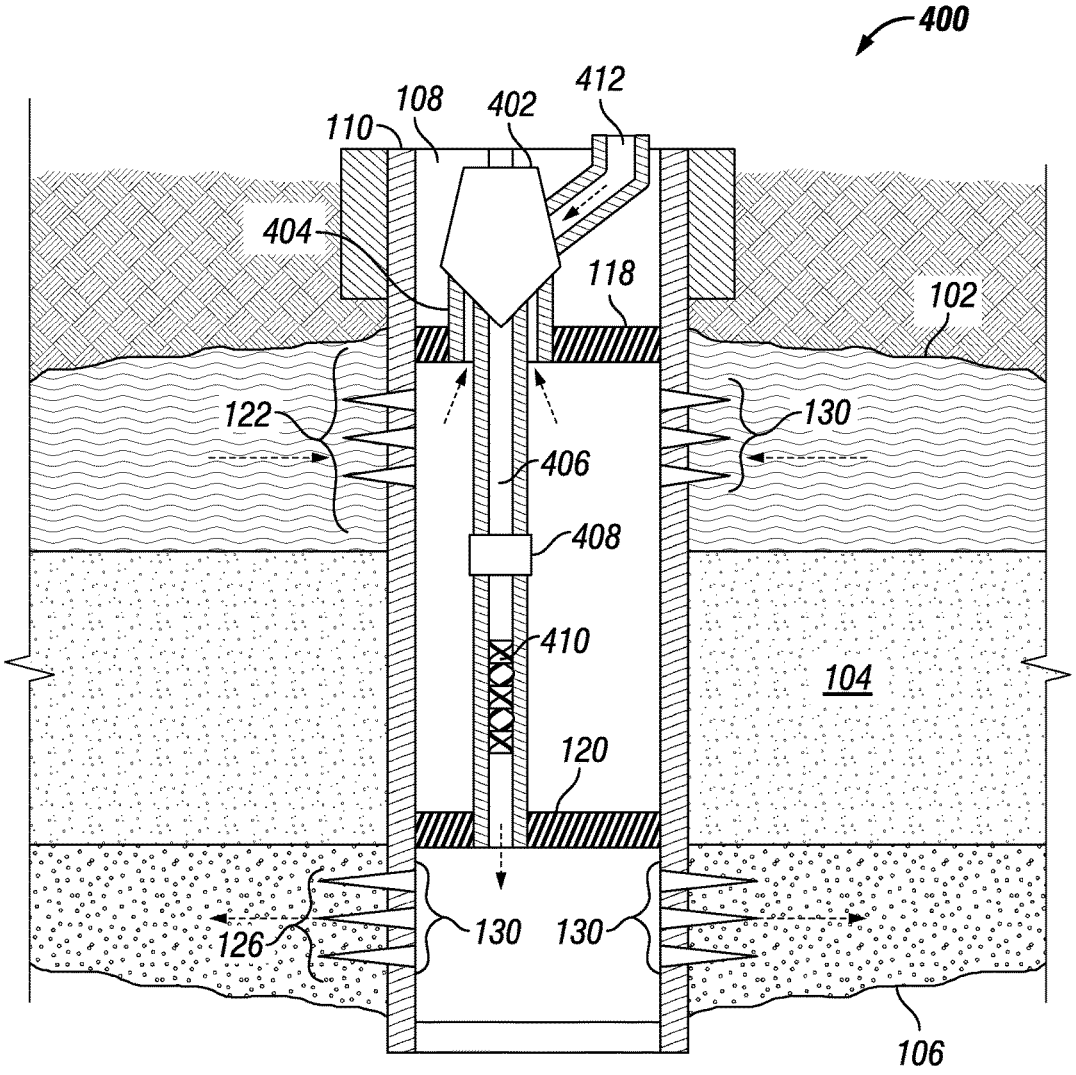
FIG. 4 illustrates a fourth example embodiment of an inline chemical injection system.

FIG. 4 illustrates a fourth example embodiment of an inline polymer dump flood injection system 400. In certain example embodiments, the injection system 400 is installed in a injection well 108 which is separated into a water collection zone 122 and an injection zone 126. In certain example embodiments, the water collection zone 122 is isolated between a first packer 118 disposed on top of the water collection zone 122 and a second packer 120 disposed between the water collection zone 122 and the injection zone 126. In certain example embodiments, the injection system 400 includes a water collection tubing 404, a water injection tubing 406, an ESP 402, a chemical injection tubing 412, and a static mixer 410. In certain example embodiments, the chemical injection tubing 412 extends from the surface to the ESP 402, and the chemical injection tubing 412 does not traverse the first packer 118. For example, the chemical injection tubing 412 is coupled to a tubing string through which a concentrated chemical solution is delivered downhole and into the ESP 402. In certain example embodiments, water flows into the water collection zone 122 from the source reservoir 102 via a plurality of perforations 130 formed in the casing 110 of the injection well 108. In certain example embodiments, the water collection tubing 404 extends from the water collection zone 122 to the ESP 402, which is located above the water collection zone 122. The water injection tubing 406 is disposed partially within the water collection tubing 404 and extends from the ESP 402 to the injection zone 126, traversing the first packer 118 and the second packer 120. The water is drawn into the ESP 402 through the water collection tubing 404 and the chemical solution is drawn into the ESP 402 through the chemical injection tubing 412, and then injected into the injection zone 126 through the water injection tubing 406. In certain example embodiments, a static mixer 410 is disposed within the water injection tubing 406 such that the water and chemical solution is mixed as it travels through the water injection tubing 406 and into the injection zone 126. The ESP 402 can be used to control the rate of water and chemical solution injected into the injection zone 126. In certain example embodiments, the water injection tubing 406 includes a flow meter 408 which monitors flow rate. In certain example embodiments, the mixed injection fluid is then injected into the injection zone 126 and ultimately injected into the surrounding target reservoir 106 via perforations formed in the casing 110. The example embodiment of the injection system 400 illustrated in FIG. 4 can accommodate the use of shear-insensitive chemical solutions, such as biopolymers, including but not limited to: xantham gum, scleroglucan, and schizophyllan.

Figure 5:
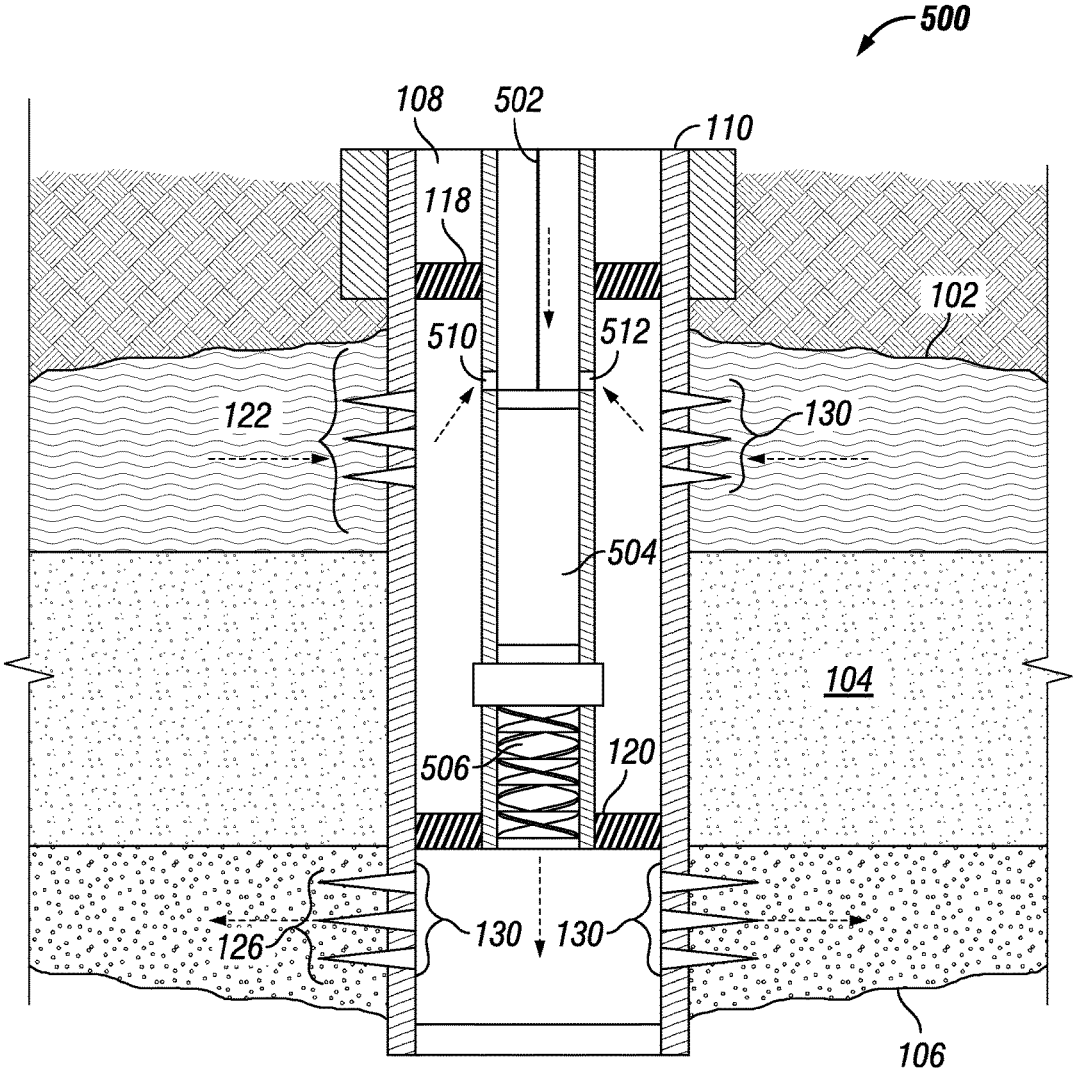
FIG. 5 illustrates a fifth example embodiment of an inline chemical injection system.

FIG. 5 illustrates a fifth example embodiment of an inline polymer dump flood injection system 500. In certain example embodiments, the injection system 500 is installed in an injection well 108 which is separated into a water collection zone 122 and an injection zone 126. In certain example embodiments, the water collection zone 122 is isolated between a first packer 118 disposed on top of the water collection zone 122 and a second packer 120 disposed between the water collection zone 122 and the injection zone 126. In certain example embodiments, the injection system 500 includes a chemical injection tubing 502, a PCP 504, and a static mixer 506. The PCP 504 can include a stator and a drive rod, as well as an inlet towards the top of the PCP 504 and an outlet towards the bottom of the PCP 504. In certain example embodiments, water flows into the water collection zone 122 from the source reservoir 102 via perforations 130 formed in the casing 110 of the injection well 108. The chemical injection tubing 502 extends into the water collection zone 122 from the surface. The PCP 504 is coupled to the chemical injection tubing 502. In certain example embodiments, one way valves 510, 512 are disposed at the junction of the chemical injection tubing 502 and the PCP 504, and the one way valves 510, 512 allow water to enter the PCP 504 from the water collection zone 122. The one way valves 510, 512 are meant to allow water from the water collection zone 122 to pass through the one way valves 510, 512 (and towards the PCP 504), but the chemical solution does not pass through the one way valves 510, 512 into the water collection zone 122. The water that passes through the one way valves 510, 512 and the chemical solution from the chemical injection tubing 502 are pumped downward through the PCP 504. For example, the water from the water collection zone 122 and the chemical solution from the chemical injection tubing 502 enter the PCP 504 through the inlet of the PCP 504 and exit through the outlet of the PCP 504 into the static mixer 506. The static mixer 506 is coupled to the PCP 504 opposite the chemical injection tubing 502. Thus, the water and chemical solution is driven into the static mixer 506 by the PCP 504, where it is mixed into an injection fluid.

In certain example embodiments, the mixed injection fluid is then injected into the injection zone 126 and ultimately injected into the surrounding target reservoir 106 via perforations 130 formed in the casing 110. The example embodiment of the injection system 300 illustrated in FIG. 5 can accommodate the use of shear-sensitive chemical solutions, such as synthetic polymers as described above.

Figure 6:
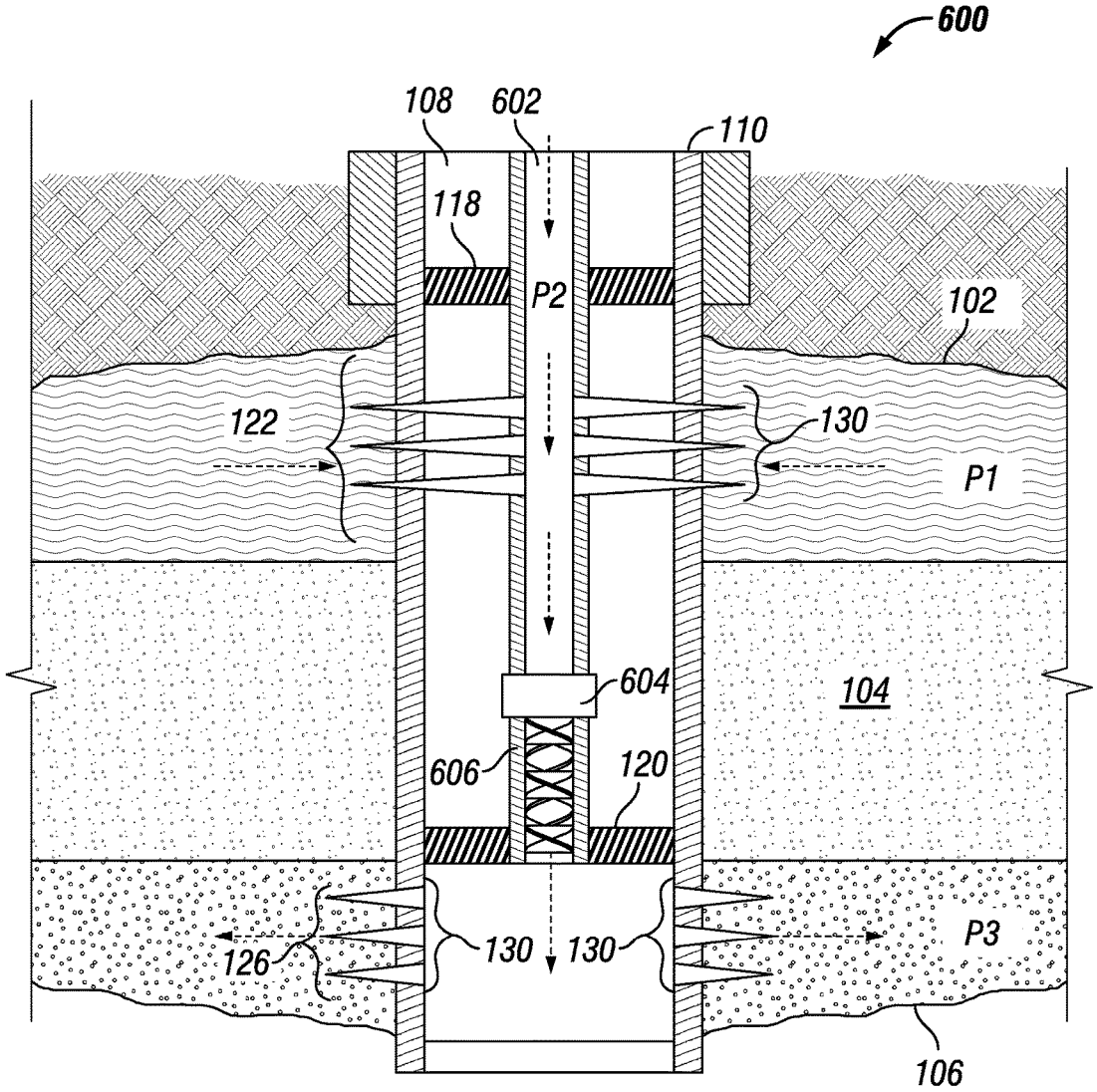
FIG. 6 illustrates a sixth example embodiment of an inline chemical injection system.

FIG. 6 illustrates a sixth example embodiment of an inline chemical dump flood injection system 600. In certain example embodiments, the injection system 600 is installed in an injection well 108 which is separated into a water collection zone 122 and an injection zone 126. In certain example embodiments, the water collection zone 122 is isolated between a first packer 118 disposed on top of the water collection zone 122 and a second packer 120 disposed between the water collection zone 122 and the injection zone 126. In certain example embodiments, the injection system 600 includes a chemical injection tubing 602 and a static mixer 606. In certain example embodiments, the chemical injection tubing 602 also includes a flow meter 604 for measuring flow rate. The chemical injection tubing 602 extends from the surface and into the injection zone 126. In certain example embodiments, water flows into the water collection zone 122 from the source reservoir 102 via perforations 130 formed in the casing 110 of the injection well 108. The source reservoir 102 has a particular pressure illustrated as P1. In certain example embodiments, the chemical injection tubing 602 also includes a plurality of perforations 130 which allows water to flow into the chemical injection tubing 602. A concentrated chemical solution with a particular pressure illustrated as P2 is pumped into the chemical injection tubing 602 from the surface. The water and the concentrated chemical solution flow into the static mixer 606 where the water and concentrated chemical solution are mixed into an injection fluid. The mixed injection fluid is then injected into the injection zone 126 and ultimately injected into the surrounding target reservoir 106 via perforations 130 formed in the casing 110. The target reservoir 106 has a particular pressure illustrated as P3. As explained further below, the pressure differences between P1, P2, and P3 drive the water, the chemical solution, or both to their destinations. The example embodiment of the injection system 600 illustrated in FIG. 6 can accommodate the use of shear-sensitive chemical solutions, such as synthetic polymers as described above.

In FIG. 6, the pressure differences between P1, P2, and P3 drive the water, the chemical solution, or both to their destinations. For example, the pressure of the source reservoir 102 is higher than the pressure of the chemical solution, and the pressure of the chemical solution is higher than the pressure of the target reservoir 106 (i.e., P1>P2>P3). The highest pressure of the source reservoir 102 causes the water to flow from the source reservoir 102 towards a region of lower pressure, that is, the water collection zone 122, the chemical injection tubing 602, and through the static mixer 606 to the target reservoir 106 with the lowest pressure. Similarly, the pressure of the chemical solution causes it to flow towards a region of lower pressure, that is, through the static mixer 606 to the target reservoir 106 with the lowest pressure. As the pressure of the source reservoir 102 is higher than the pressure of the chemical solution, the chemical solution does not flow towards the source reservoir 102.

Like in FIG. 6, the pressure differences can drive the water, the chemical solution, or both to their destinations in some of the other embodiments as well. Moreover, a pump (e.g., the pump 116, the ESP 206, 402 and the PCP 302, 504), a valve (e.g., the one way valves 510, 512), pressure differences, or any combination thereof can be used to drive the water, the chemical solution, or both to their destinations. For example, in FIG. 4, (a) the highest pressure of the source reservoir 102 causes the water to flow from the source reservoir 102 towards a region of lower pressure such as the water collection zone 122, (b) the contents of the water collection zone 122 are drawn into the ESP 402 by the operation of the ESP 402, and (c) the contents in the ESP 402 travel through the water injection tubing 406 and into the injection zone 126 by the operation of the ESP 402.

Modifications can also be made to one or more of the embodiments. In some embodiments, an interlock can be added and utilized to stop operation of a pump. For example, in FIG. 4, an interlock can be added between the ESP 402 and a pump (not shown) that drives the chemical solution into the chemical injection tubing 412. If the ESP 402 stops operating, then the pump that is not shown will also stop operating and cease pumping the chemical solution into the chemical injection tubing 412. An interlock can also be added to other embodiments with two pumps.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method of inline water injection, comprising:

collecting water from a source reservoir into a water collection zone of an injection well, wherein the injection well is in fluid communication with the source reservoir and a target reservoir, wherein the injection well is drilled into a formation, and wherein the source reservoir and the target reservoir are different reservoirs in the formation;

injecting the water from the source reservoir through a static mixer, wherein the static mixer is disposed in the injection well and the static mixer is intended to remain in the injection well for an economic life of the injection well;

delivering and injecting a concentrated chemical solution from a source outside of the injection well into the static mixer while injecting the water from the source reservoir through the static mixer;

mixing the water from the source reservoir and the concentrated chemical solution in the static mixer, resulting in an injection fluid;

injecting the injection fluid into the target reservoir to mobilize hydrocarbons in the target reservoir towards a producing well; and recovering the hydrocarbons mobilized by the injection fluid from the producing well.

2. The method of claim 1, wherein the water is injected through a water injection tubing, wherein the water enters the water injection tubing via a plurality of perforations in the water injection tubing.

3. The method of claim 2, wherein the water is injected at a water inflow rate controlled by a pump coupled to the water injection tubing.

4. The method of claim 1, wherein the concentrated chemical solution is injected at a chemical inflow rate controlled at the source.

5. The method of claim 1, wherein the water is injected via an electrical submersible pump or a progressive cavity pump.

6. The method of claim 1, further comprising:

delivering the concentrated chemical solution into the injection well at a chemical inflow rate, wherein the chemical inflow rate is determined based on a chemical concentration of the concentrated chemical solution, a desired chemical concentration of the injection fluid, and a water inflow rate.

7. The method of claim 1, further comprising:

delivering a concentrated polymer solution into the injection well;

delivering a concentrated surfactant solution into the injection well; and mixing the water, concentrated polymer solution, and concentrated surfactant solution in the static mixer.

8. The method of claim 7, wherein the concentrated polymer solution is delivered into the injection well at a polymer inflow rate and the concentrated surfactant solution is delivered into the injection well at a surfactant inflow rate, wherein the polymer inflow rate and the surfactant inflow rate is determined based on a polymer concentration of the concentrated polymer solution, a desired concentration of the injection fluid, surfactant concentration of the concentrated surfactant solution, a desired surfactant concentration of the injection fluid, and a water inflow rate.

9. The method of claim 1, wherein the concentrated chemical solution is shear-sensitive, and integrity of the concentrated chemical solution is maintained when injecting the concentrated chemical solution from the source to the static mixer and when the concentrated chemical solution is mixed with the water in the static mixer.

10. An inline water injection system, comprising:

a first packer disposed within an injection well at a first level, wherein the injection well is drilled into a formation;

a second packer disposed within the injection well at a second level below the first packer, wherein the injection well comprises a water collection zone between the first packer and the second packer;

a static mixer disposed within the injection well and the static mixer is intended to remain in the injection well for an economic life of the injection well; and one or more injection tubings disposed within the injection well traversing the first and second packers, wherein the one or more injection tubings deliver water from an adjacent source reservoir and a chemical solution from an above-ground source into the static mixer, wherein the static mixer mixes the water from the source reservoir and the chemical solution into an injection fluid, and wherein the injection fluid is injected into a target reservoir adjacent the injection well to mobilize hydrocarbons in the target reservoir towards a producing well for recovering the hydrocarbons mobilized by the injection fluid from the producing well, and wherein the source reservoir and the target reservoir are different reservoirs in the formation.

11. The inline water injection system of claim 10, further comprising:

a water injection tubing, wherein the water injection tubing collects the water from the source reservoir and injects the water into the static mixer.

12. The inline water injection system of claim 11, wherein the water injection tubing is coupled to a pump configured to pump the water into the static mixer.

13. The inline water injection system of claim 10, further comprising:

a chemical injection tubing, wherein the chemical injection tubing traverses the water collection zone and delivers the chemical solution into the static mixer.

14. The inline water injection system of claim 10, wherein the static mixer is disposed below the water collection zone and below the one or more injection tubings.

15. The inline water injection system of claim 10, wherein the static mixer is disposed inside the one or more injection tubings.

16. The inline water injection system of claim 10, comprising:

a pump coupled to the one or more injection tubings, wherein the pump is configured to pump the water, the chemical solution, or both into the static mixer.

17. A method of inline water injection, comprising:

pumping a concentrated chemical solution into an injection tubing, wherein the injection tubing is disposed within an injection well, and wherein the injection well is drilled into a formation;

collecting water from a source reservoir into the injection tubing, wherein the injection well is in fluid communication with the source reservoir, and wherein the source reservoir is in the formation;

injecting the concentrated chemical solution and the water from the source reservoir through a mixer disposed in the injection well, wherein the static mixer is intended to remain in the injection well for an economic life of the injection well, and wherein the concentrated chemical solution and the water from the source reservoir are mixed into an injection fluid;

injecting the injection fluid into a target reservoir in fluid communication with the injection well to mobilize hydrocarbons in the target reservoir towards a producing well, wherein the target reservoir is in the formation, and wherein the source reservoir and the target reservoir are different reservoirs in the formation; and recovering the hydrocarbons mobilized by the injection fluid from the producing well.

18. The method of claim 17, further comprising:

pumping, via a pump, the concentrated chemical solution and the water through the injection tubing and into the mixer.

19. The method of claim 18, wherein the pump is an electrical submersible pump or a progressive cavity pump.

20. The method of claim 17, wherein the mixer is a non-shearing mixer.

21. The method of claim 17, further comprising:

controlling an inflow rate of the water, the concentrated chemical solution, or both, into the mixer.

22. The method of claim 17, further comprising:

pumping the concentrated chemical solution into the injection tubing at a chemical inflow rate, wherein the chemical inflow rate is determined based on a chemical concentration of the concentrated chemical solution, a desired chemical concentration of the injection fluid, and a water inflow rate.

23. The method of claim 17, wherein the concentrated chemical solution includes a concentrated polymer solution and a concentrated surfactant solution, wherein the concentrated polymer solution and the concentrated surfactant solution are mixed at a ratio determined based on a polymer concentration of the concentrated polymer solution, a desired concentration of the injection fluid, surfactant concentration of the surfactant solution, a desired surfactant concentration of the injection fluid, and a water inflow rate.

* * * * *